US006971302B2

(12) United States Patent
Lee

(10) Patent No.: US 6,971,302 B2
(45) Date of Patent: Dec. 6, 2005

(54) HYDRAULIC CIRCUIT FOR HEAVY EQUIPMENT OPTION APPARATUS USING BOOM CONFLUENCE SPOOL

(75) Inventor: Jae Hoon Lee, Kyungsangnam-do (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 0 days.

(21) Appl. No.: 10/847,929

(22) Filed: May 17, 2004

(65) Prior Publication Data

US 2004/0261405 A1 Dec. 30, 2004

(30) Foreign Application Priority Data

Jun. 25, 2003 (KR) ..... 10-2003-0041365

(51) Int. Cl.[7] ..... F15B 13/04
(52) U.S. Cl. ..... 91/445; 91/448
(58) Field of Search ..... 60/399, 403; 91/445, 91/448, 461, 432

(56) References Cited

U.S. PATENT DOCUMENTS 5,333,449 A * 8/1994 Takahashi et al. ..... 91/448
5,493,950 A * 2/1996 Kim ..... 91/461
6,745,564 B2 * 6/2004 Koo ..... 91/461

FOREIGN PATENT DOCUMENTS

EP 0 620 370 10/1994

* cited by examiner

*Primary Examiner*—Edward K. Look
*Assistant Examiner*—Michael Leslie
(74) *Attorney, Agent, or Firm*—Ladas and Parry LLP

(57) ABSTRACT

There is provided a hydraulic circuit for an option apparatus of heavy equipment using a boom confluence spool, comprising a poppet valve installed at a flow path of a supply side of a spool for the option apparatus, a boom confluence spool that controls the flow rate supplied to the option apparatus and work apparatus and is installed at a direct upstream of the spool of the option apparatus, a second electromagnetic proportion reducing valve that is installed at a flow path between the pilot pump and the boom confluence spool and outputs a secondary pressure in response to an electric signal from the controller and controls the boom confluence spool, and a first spool that is installed at a downstream of the poppet valve and is switched when a pressure difference between upstream and downstream of the boom confluence spool is larger than a set value.

10 Claims, 5 Drawing Sheets

HYDRAULIC CIRCUIT FOR HEAVY EQUIPMENT OPTION APPARATUS USING BOOM CONFLUENCE SPOOL

BACKGROUND OF THE INVENTION

1. Field of the Invention

The present invention relates to a hydraulic circuit for heavy equipment option apparatus using a boom confluence spool capable of supplying a certain amount of oil needed in an option apparatus in the case that a combined work is performed by engaging an option apparatus to a work apparatus such as a boom, etc. based on a working condition, and in particular to a hydraulic circuit for heavy equipment option apparatus using a boom confluence spool capable of decreasing the number of parts using a boom confluence spool as a spool for controlling the amount of oil supplied to an option apparatus by engaging an option apparatus such as a breaker, etc. to a work apparatus.

2. Description of the Background Art

Heavy equipment such as an excavator, etc. is designed to operate in such a manner that a bucket is exchanged with an option apparatus such as a breaker, shear, etc. for thereby maximizing working condition or working efficiency.

At this time, a plurality of spools for work apparatus and spools for option apparatus are installed at a main control valve for thereby controlling speed, force and direction of a work apparatus or an option apparatus.

The term "negative flow control" represents a method that in the case that a pilot signal pressure from an upstream of a pilot signal generator installed at a downstream of a center bypass path is high, a discharge flowrate of a hydraulic pump is decreased, and in the case that the pilot signal pressure is low, a discharge flowrate of a hydraulic pump is increased (refer to line "a" of FIG. 2).

In addition, the term "positive flow control" represents a method that in the case that a pilot signal pressure applied to a directional valve capable of controlling a speed, force and direction supplied to an actuator is high, a discharge flowrate of a hydraulic pump is increased, and in the case that the pilot signal pressure is low, a discharge flowrate of a hydraulic pump is decreased (refer to line "b" of FIG. 2).

As shown in FIG. 1, a hydraulic circuit for heavy equipment option apparatus in a conventional art includes a variable displacement hydraulic pump 2 and a pilot pump 3 connected with an engine 1, a work apparatus 19 and an option apparatus 4 connected with the hydraulic pump 2, and a main control valve 6 that is installed at a flow path between the hydraulic pump 2 and the work apparatus 19, and the option apparatus 4 and includes an option apparatus spool 5 and a work apparatus spool 18 for controlling a driving, stop and direction change of the work apparatus 19 and option apparatus 4.

There are further provided a first electromagnetic proportion reducing valve 8 that is installed at a flow path between the pilot pump 3 and the hydraulic pump 2 and outputs a secondary pressure corresponding to an electric signal applied from a controller 7 and controls an displacement of the hydraulic pump 2, and a remote control valve 9 for controlling a pilot signal pressure capable of controlling a corresponding spool of the main control valve 6.

In the drawings, reference numeral 10 represents a main relief valve capable of preventing an over pressure in the hydraulic circuit, and 11 represents an flowrate adjusting apparatus to option apparatus for inputting a signal corresponding to an oil flow amount required by the option apparatus 4 into a controller 7 for thereby controlling an flowrate supplied to the option apparatus 4.

As the option apparatus 4, a breaker, shear or rotator is engaged to the work apparatus 19 for thereby achieving a certain work. The pilot signal pressure is applied from the pilot pump 3 to the option apparatus spool 5, and the option apparatus spool 5 is switched in the right or left direction. Therefore, the working oil from the hydraulic pump 2 is supplied to the option apparatus 4 through the option apparatus spool 5 for thereby performing a certain work.

At this time, in the case that the option apparatus 4 uses the maximum flowrate from the hydraulic pump 2, the option apparatus 4 may be damaged due to an over speed. In this case, a proper flowrate less than the maximum discharge flowrate of the hydraulic pump 2 is required. A circuit capable of limiting the maximum discharge flowrate of the hydraulic pump 2 is adapted so that a proper flowrate required by each option apparatus 4 is discharged. Namely, as a signal corresponding to a certain flowrate is inputted using an additional flowrate adjusting apparatus 11 to option apparatus 4 so that a certain flowrate is supplied to the option apparatus 4, the controller 7 outputs an electric current value corresponding to the input signal to the first electromagnetic proportion reducing valve 8.

As shown in FIG. 3, the first electromagnetic proportion reducing valve 8 outputs a signal pressure (referred to secondary pressure passing through the port A) from the pilot pump 3 to correspond to the electric current value, so that a certain flowrate required by the option apparatus 4 is discharged by limiting the maximum discharge flowrate of the hydraulic pump 2.

In the conventional option apparatus hydraulic circuit (referred to a negative flow control method indicated by the line "a" of FIG. 2), in the case that a combined work is performed by concurrently performing the option apparatus 4 and the work apparatus 19, and the maximum discharge flowrate of the hydraulic pump 2 is limited, the operation speed of the work apparatus 19 may become slow, and the combined operation is not properly performed, so that the workability is decreased. The work apparatus 19 or option apparatus 4 is not properly performed as the operation controls, so that the safety problem occurs.

In addition, in case of the hydraulic system designed to discharge the maximum flowrate from the hydraulic pump 2 during the combined operation (referred to a positive flow control method indicated by the curve B of FIG. 2), the flowrate more than the flowrate required by the option apparatus 4 is supplied to the option apparatus 4 based on the difference of the load pressure occurring between the option apparatus 4 and the work apparatus 19 when concurrently performing the work apparatus 19 and option apparatus 4. In this case, the option apparatus 4 may be damaged, and the durability may be decreased. The option apparatus 4 may be exchanged.

SUMMARY OF THE INVENTION

Accordingly, it is an object of the present invention to provide a hydraulic circuit for heavy equipment option apparatus using a boom confluence spool in which a desired operation speed is obtained, and a workability is enhanced in such a manner that a flowrate is supplied to an option apparatus by the amount required by an option apparatus in the case that an option apparatus is operated together with other actuator.

It is another object of the present invention to provide a hydraulic circuit capable of enhancing a durability by preventing a certain overflow from being supplied to an option apparatus based on a load pressure difference between other actuator and an option apparatus.

It is further another object of the present invention to provide a hydraulic circuit capable of decreasing a unit cost based on a reduction of number of parts in such a manner that a flowrate supplied to an option apparatus is controlled using a port that is not used in a boom-up confluence spool.

To achieve the above objects, in a hydraulic circuit for an option apparatus of heavy equipment that includes a variable displacement hydraulic pump and a pilot pump, a work apparatus and an option apparatus connected with the hydraulic pump, a main control valve installed at a flow path between the hydraulic pump and the work apparatus and option apparatus for thereby controlling a flow direction of an working oil, a first electromagnetic proportion reducing valve for variably controlling a discharge flowrate of the hydraulic pump in response to an electric signal from a controller, and a remote control valve that controls a signal pressure capable of controlling a spool of the main control valve, there is provided a hydraulic circuit for an option apparatus of heavy equipment using a boom confluence spool, comprising a poppet valve installed at a flow path of a supply side of a spool for the option apparatus wherein the poppet valve is opened and closed; a boom confluence spool that is switched when a pilot signal pressure is supplied and controls a flowrate supplied to the option apparatus and work apparatus and is installed at a direct upstream of the spool for the option apparatus; and a first spool that is installed at a downstream of the poppet valve and is switched when a pressure difference between the upstream and downstream of the boom confluence spool is larger than a set value and has a function capable of decreasing an opening degree of the poppet valve, which is a function of a pressure compensation type flow control valve.

In a preferred embodiment of the present invention, a second electromagnetic proportion reducing valve is installed at a flow path between the pilot pump and the boom confluence spool and outputs a secondary pressure in response to an electrical signal from the controller and controls a stroke of the boom confluence spool.

At least one between the first spool and the poppet valve is installed in the interior or an outer surface of the main control valve.

The poppet valve and the first spool are installed at a flow path between the boom confluence spool and the option apparatus spool.

The remote control valve capable of switching the option apparatus spool or the work apparatus spool may be a hydraulic type or an electrical type.

In the case of the electric type remote control valve, an electromagnetic proportion reducing valve or a solenoid valve is additionally installed between the remote control valve and the main control valve.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The preferred embodiments of the present invention will be described with reference to the accompanying drawings.

Figure 1:
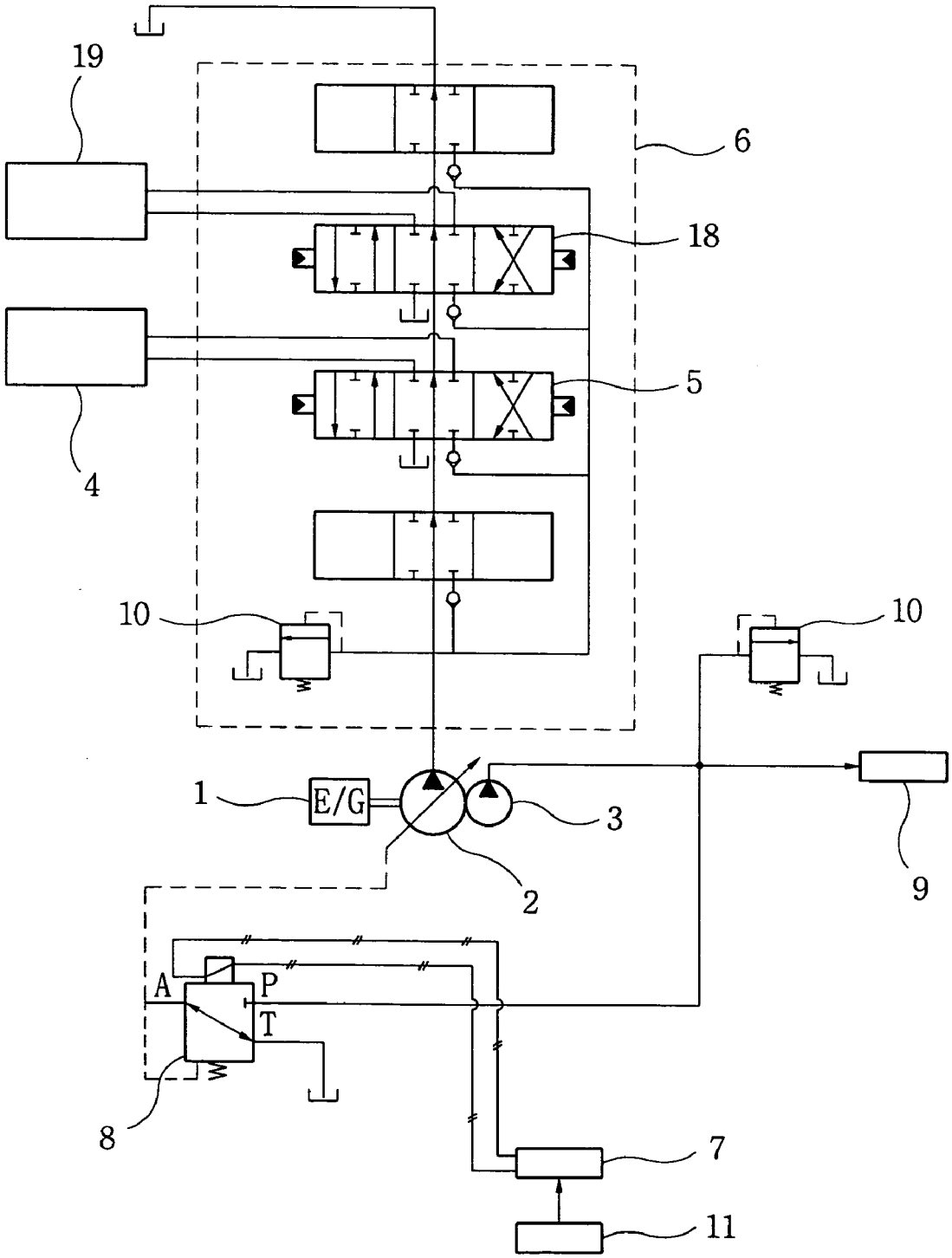
Fig. 1 PRIOR ART
FIG. 1 is a view illustrating a hydraulic circuit for an option apparatus of heavy equipment in the conventional art.
Figure 4:
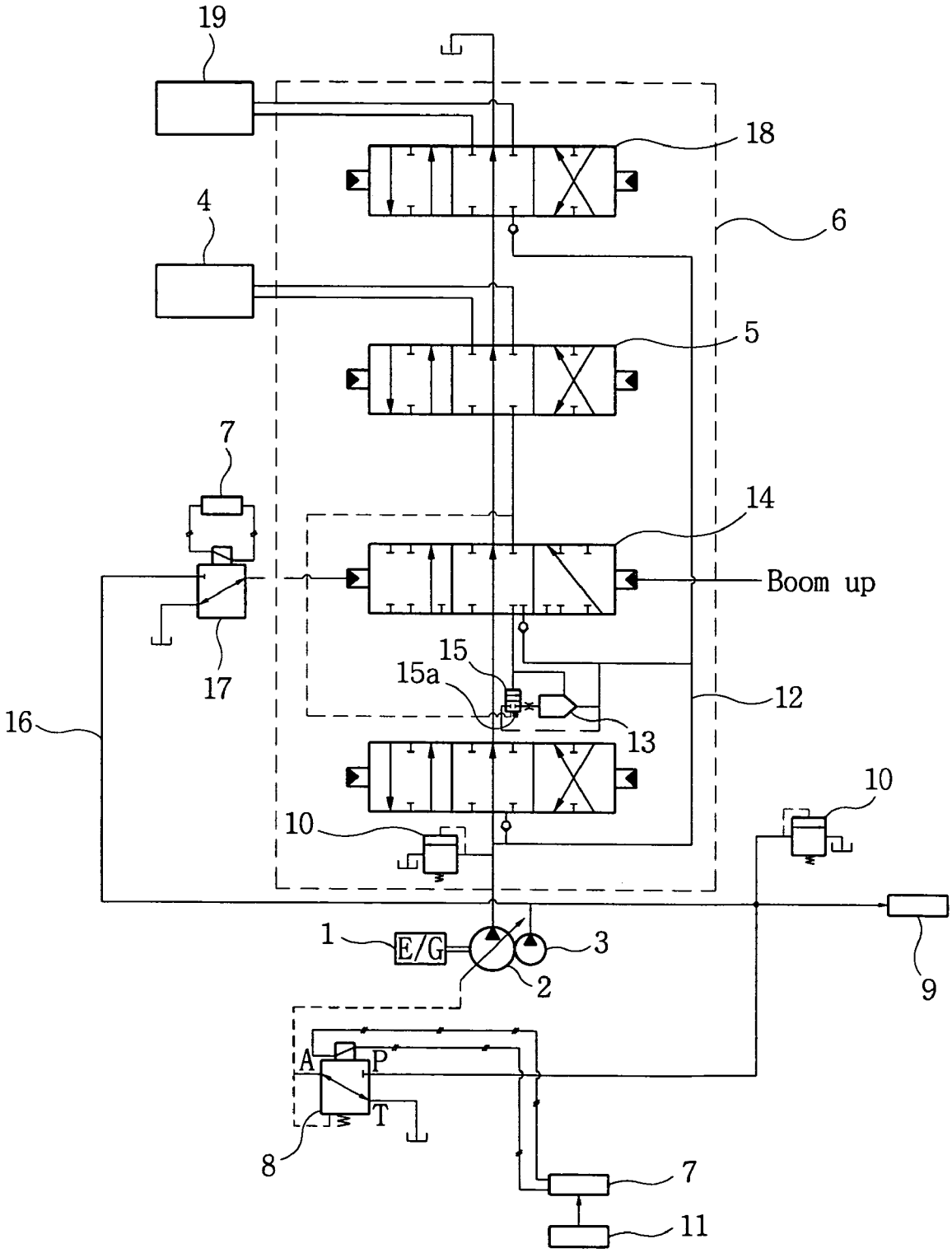
FIG. 4 is a view illustrating a hydraulic circuit for an option apparatus of heavy equipment using a boom confluence spool according to the present invention.

As shown in FIG. 4, the present invention is basically adapted to a hydraulic circuit for an option apparatus for heavy equipment that includes a variable displacement hydraulic pump 2 and a pilot pump 3 connected with an engine 1, a work apparatus 19 and an option apparatus 4 connected with the hydraulic pump 2, a main control valve 6 installed at a flow path between the hydraulic pump 2 and the work apparatus 19 and option apparatus 4 and including an option apparatus spool 5 and a work apparatus spool 18 capable of controlling a flowing direction of an working oil, a first electromagnetic proportion reducing valve 8 for variably controlling a discharge flowrate of the hydraulic pump 2 in response to an electrical signal applied from the controller 7, and a remote control valve 9 for controlling a signal pressure capable of switching a spool of the main control valve 6. The above construction is actually similar with the construction of FIG. 1. The detailed descriptions of the construction and operation will be omitted, and the duplicating reference numerals are given the same reference numerals.

Therefore, the hydraulic circuit for an option apparatus of heavy equipment according to the present invention includes a poppet valve 13 installed at a supply side flow path 12 of an option apparatus spool 5 with the state capable of opening and closing, a boom confluence spool 14 (referred to a spool having both a boom-up confluence function and a flow control function of an option apparatus) installed at a flow path between the poppet valve 13 and the option apparatus spool 5 and switched when a pilot signal pressure is supplied, for thereby controlling a flowrate supplied to the option apparatus 4 and the work apparatus 19.

There is further provided a first spool 15 that is installed at a downstream of the poppet valve 13 and has a function of pressure compensation type flow control valve preventing an overflow set in the option apparatus 4 by decreasing an opening degree of the poppet valve 13 in the case that a pressure difference between the upstream and downstream of the boom confluence spool 14 is larger than a set value.

In addition, there is further provided a second electromagnetic proportion reducing valve 17 that is installed at a flow path 16 between the pilot pump 3 and the boom confluence spool 14 and outputs a secondary pressure corresponding to an electrical signal inputted from the controller 7 and controls a stroke of the boom confluence spool 14.

At this time, at least one between the first spool 15 and the poppet valve 13 may be installed at an inner side or an outer side of the main control valve 6.

In the drawings, reference numeral 10 represents a main relief valve, 11 represents a flowrate adjusting apparatus to option apparatus, and 15*a* represents a valve spring.

The operation of the hydraulic circuit for an option apparatus of heavy equipment using a boom confluence spool according to the present invention will be described.

A) The work performed by engaging an option apparatus such as a breaker, etc. will be described.

As shown in FIG. 4, the second electromagnetic proportion reducing valve 17 outputs a secondary pressure corresponding to an electrical signal from controller 7 and supply it to a left side port of the boom confluence spool 14, so that the boom confluence spool 14 is switched in the right direction.

Therefore, the working oil from the hydraulic pump 2 sequentially passes through the poppet valve 13 and the boom confluence spool 14 installed at the supply side flow path 12, and it is supplied to the option apparatus 4 through the option apparatus spool 5 switched in accordance with a pilot signal pressure supplied when operating a remote control valve 9.

At this time, the working oil from the hydraulic pump 2 can be supplied by the amount required by the option apparatus 4 such as breaker or shear.

Namely, when a signal corresponding to the flowrate needed by the option apparatus 4 is inputted into the controller 7 by using the option flowrate adjusting apparatus 11, the controller 7 outputs a electric current value corresponding to an input signal to the first electromagnetic proportion reducing valve 8, so that the first electromagnetic proportion reducing valve 8 outputs a secondary pressure corresponding to the electric current value for thereby limiting the maximum discharge flowrate of the hydraulic pump 2. Therefore, it is possible to discharge a certain amount of working oil needed by the option apparatus 4.

Figure 2:
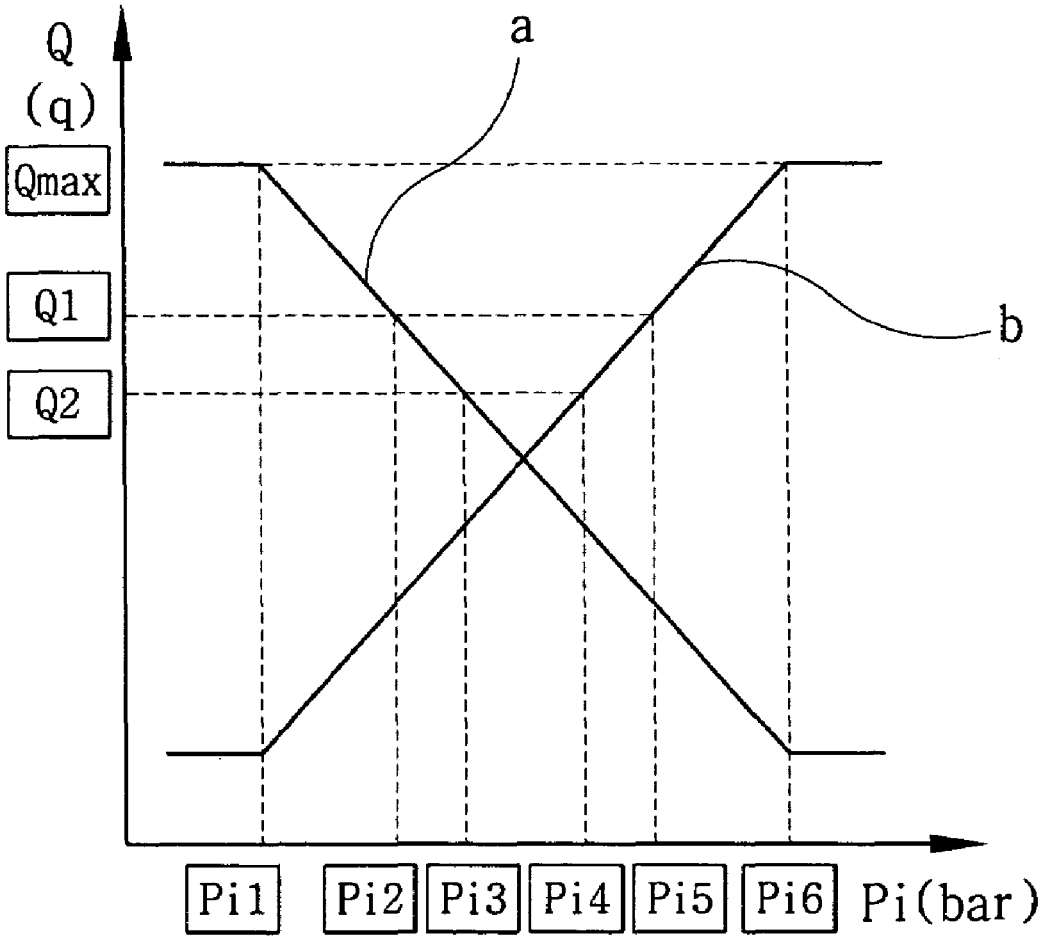
FIG. 2 is a graph of a discharge flow control method of a hydraulic pump.
Figure 3:
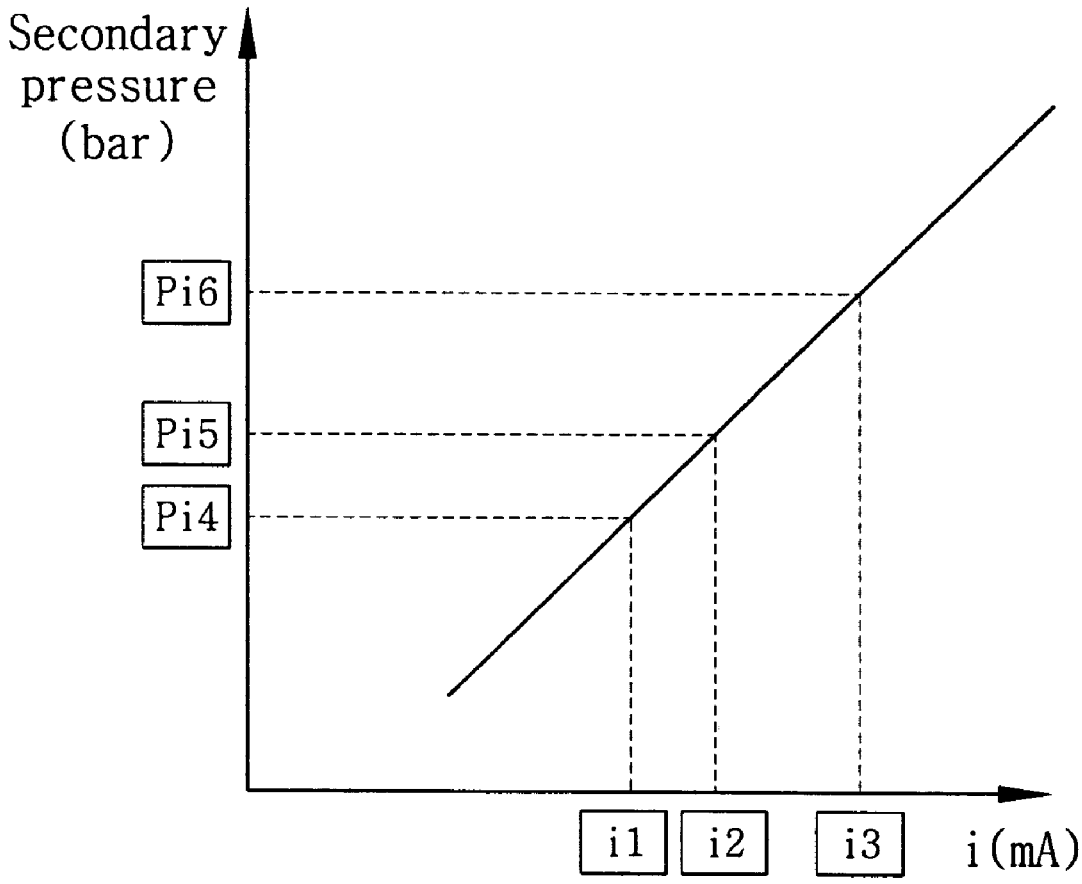
FIG. 3 is a graph of a relationship between a secondary pressure and an electric current value of an electromagnetic proportion reducing valve.

For example, as shown in FIGS. 2 and 3, if the flowrate needed by the option apparatus is Q2, the electric current of i1 is outputted from the controller 7, and as shown in FIG. 3, the first electromagnetic proportion reducing valve 8 outputs a secondary pressure of Pi4 corresponding to i1 to the hydraulic pump 2, and as shown in FIG. 2, the hydraulic pump 2 discharges the flowrate of Q2.

B) The combined work capable of concurrently operating the option apparatus and the work apparatus will be described.

As shown in FIG. 4, in the case that the combined work is performed by concurrently driving the work apparatus 19 and the option apparatus 4, as a certain electrical signal (referred to an electrical signal corresponding to the flowrate greater than the flowrate needed by the option apparatus) is inputted into the first electromagnetic proportion reducing valve 8 in accordance with a control signal from the controller 7, the secondary pressure discharged from the pilot pump 3 and generated when passing through the first electromagnetic proportion reducing valve 8 (referred to the port A) is applied to the discharge flow controller of the hydraulic pump 2, so that the hydraulic pump 2 discharges more flowrate than the flowrate needed by the option apparatus 4.

Namely, if the flowrate needed during the combined operation is Q1(Q2<Q1·Qmax), the controller 7 outputs i2(i1<i2·i3), and the first electromagnetic proportion reducing valve 8 outputs Pi5(Pi4<Pi5·Pi6), and the hydraulic pump 2 discharges Q1(Q2<Q1·Qmax). In the conventional art, only Q2 is discharged, so the speed is slow in the case of the combined operation. Thereby, a part of the working oil from the hydraulic pump 2 is supplied to the work apparatus 19 based on the spool switch for the work apparatus 19 of the main control valve 6, and at the same time a part of the working oil sequentially passes through the poppet valve 13 and the boom confluence spool 14 (referred to the left side port in the drawing) installed in the supply side flow path and is supplied to the option apparatus 4. Therefore, it is possible to concurrently operate the work apparatus 19 and the option apparatus 4, so that the combined work is efficiently achieved.

At this time, in the case that the operation pressure of option apparatus is lower than the operation pressure of the work apparatus 19 by a load pressure difference occurring between the work apparatus 19 and the option apparatus 4 having a different operation pressure, when the flowrate from the hydraulic pump 2 is supplied to the option apparatus 4 by over a certain flowrate, the pressure difference between the upstream and the downstream of the boom confluence spool 14 is increased as compared to the set value, so that the first spool 15 is switched to the lower direction as shown in FIG. 4. Therefore, a part of the working oil of the supply side flow path 12 is applied as a pilot signal pressure to the downstream of the poppet valve 13 through the first spool 15 for thereby decreasing the opening degree of the poppet valve 13. The opening degree keeps decreasing until the pressure difference between upstream and downstream of the boom confluence spool 14 becomes a set value. Namely, the decreasing of the opening degree stops at the time when the working oil flows by the amount needed by the option apparatus.

Therefore, in the present invention, it is possible to prevent the working oil from the hydraulic pump 2 from being supplied by the amount exceeding the amount needed by the option apparatus. Therefore, it is possible to preventing the decrease of the durability of the option apparatus 4, and the life span of the system is increased.

In the hydraulic circuit for the option apparatus of heavy equipment using a boom confluence spool according to the present invention, the hydraulic pump 2 is designed to discharge the maximum flowrate from the hydraulic pump 2 during the combined work by concurrently operating the work apparatus 19 and the option apparatus 4, so that it is possible to enhance the workability based on a proper supply ratio of the working oil to the work apparatus 19 and the option apparatus 4.

In addition, in the case that the working oil is supplied by the amount greater than the amount needed by the option apparatus 4 based on a load pressure difference of the work apparatus 19 and the option apparatus 4, the pressure difference between upstream and downstream of the boom confluence spool 14 is increased, for thereby automatically decreasing the opening degree of the poppet valve 13 installed at the supply side flow path 12, so that it is possible to supply a desired flow amount of working oil to the option apparatus 4.

And in order to control the flowrate supplied to the option apparatus 4, the port (left port in the drawing) that is not used in the boom confluence spool 14 is used without using the additional spool for thereby decreasing the number of parts, and the unit cost is decreased and the work time for fabricating and assembling the hydraulic system is decreased, and the workability is enhanced.

Figure 5:
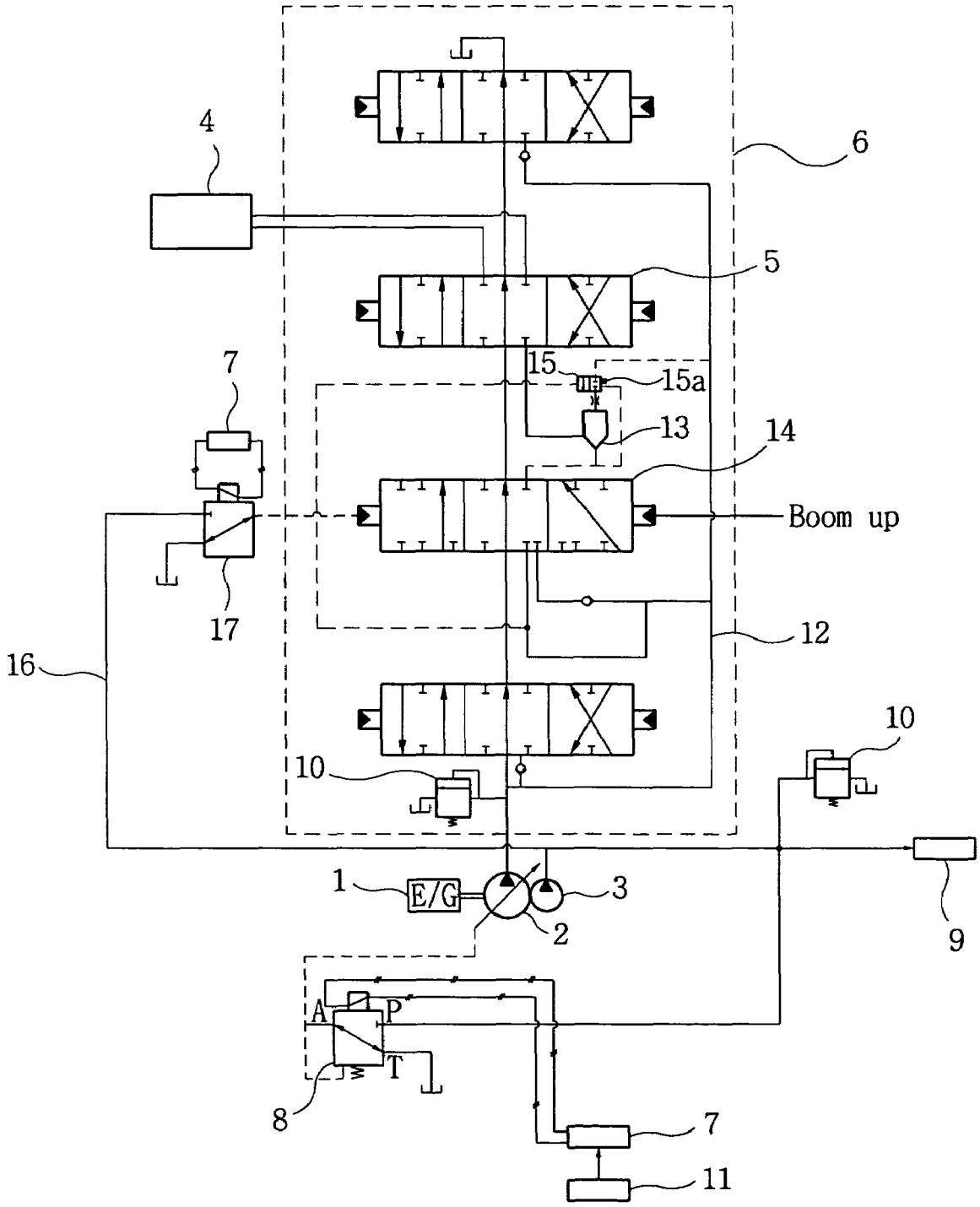
FIG. 5 is a view illustrating a hydraulic circuit for an option apparatus of heavy equipment using a boom confluence spool according to another embodiment of the present invention.

As shown in FIG. 5, in the hydraulic circuit for the option apparatus of heavy equipment using a boom confluence spool according to another embodiment of the present invention, the poppet valve 13 and the first spool 15 are installed between the boom confluence spool 14 and the option apparatus spool 5. In addition, in the same construction as the construction shown in FIG. 4, the option apparatus 4 is connected with the hydraulic pump 2. The main control valve 6 includes the option apparatus spool 5 installed between the hydraulic pump 2 and the option apparatus 4. The remote control valve 9 is adapted to control a pilot signal pressure capable of switching a spool of the main control valve 6. The first electromagnetic proportion reducing valve 8 controls a discharge amount of the hydraulic pump 2 by outputting a secondary pressure corresponding to an electrical signal inputted from the controller 7. The descriptions of the above same construction will be omitted. The duplicating elements are given the same reference numeral.

In the present invention, the space is not limited for designing a hydraulic system or assembling and engaging the parts. Therefore, the design performance and workability are enhanced.

The hydraulic circuit for an option apparatus of heavy equipment according to the present invention has the following advantages.

In the case that the work apparatus and the option apparatus are concurrently driven, since the working oil is supplied by a needed amount, a desired operation speed is achieved, and the workability is enhanced. It is possible to prevent the working oil from being supplied by the amount greater than the amount set in the option apparatus based on a load pressure difference between the work apparatus and the option apparatus.

In addition, the working oil supplied to the option apparatus is controlled using the port that is not used in the boom confluence spool, so that the number of parts is decreased, and the unit cost is decreased.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. In a hydraulic circuit for an option apparatus of heavy equipment that includes a variable displacement hydraulic pump and a pilot pump, a work apparatus and an option apparatus connected with the hydraulic pump, a main control valve installed at a flow path between the hydraulic pump and the work apparatus and option apparatus for thereby controlling a flow direction of an working oil, a first electromagnetic proportion reducing valve for variably controlling a discharge flowrate of the hydraulic pump in response to an electric signal from a controller, and a remote control valve that controls a signal pressure capable of switching a spool of the main control valve, a hydraulic circuit for an option apparatus of heavy equipment using a boom confluence spool, comprising:

a poppet valve installed at a flow path of a supply side of a spool for the option apparatus wherein said poppet valve is opened and closed;

a boom confluence spool that is switched when a pilot signal pressure is supplied and controls the flowrate supplied to the option apparatus and work apparatus and is installed at a direct upstream of the spool of the option apparatus;

a second electromagnetic proportion reducing valve that is installed at a flow path between the pilot pump and the boom confluence spool and outputs a secondary pressure in response to an electric signal from the controller and controls a stroke of the boom confluence spool; and a first spool that is installed at a downstream of the poppet valve and is switched when a pressure difference between upstream and downstream of the boom confluence spool is larger than a set value and has a function capable of decreasing an opening degree of the poppet valve.

2. The circuit of claim 1, wherein said second electromagnetic proportion reducing valve outputs a secondary pressure same as the first electromagnetic proportion reducing valve in response to an electrical signal from the controller.

3. The circuit of claim 1, wherein at least one of the first spool and the poppet valve is installed in the interior of the main control valve.

4. The circuit of claim 2, wherein at least one of the first spool and the poppet valve is installed in the interior of the main control valve.

5. The circuit of claim 1, wherein at least one of the first spool and the poppet valve is installed at an outer surface of the main control valve.

6. The circuit of claim 2, wherein at least one of the first spool and the poppet valve is installed at an outer surface of the main control valve.

7. The circuit of claim 1, wherein said poppet valve and said first spool are installed at a flow path between the boom confluence spool and the option apparatus spool.

8. The circuit of claim 2, wherein said poppet valve and said first spool are installed at a flow path between the boom confluence spool and the option apparatus spool.

9. The circuit of claim 1, wherein when switching a spool of the main control valve, either a hydraulic or electric remote control valve is used.

10. The circuit of claim 2, wherein when switching a spool of the main control valve, either a hydraulic or electric remote control valve is used.

* * * * *